United States Patent [19]

Brown

[11] Patent Number: 4,471,710

[45] Date of Patent: Sep. 18, 1984

[54] METHOD OF MANUFACTURING AND APPLICATIONS OF A BUILDING PANEL HAVING A COMPOUND OR COMPLEX CURVATURE

[76] Inventor: James W. Brown, P.O. Box 14, North, Va. 23128

[21] Appl. No.: 9,047

[22] Filed: Feb. 2, 1979

[51] Int. Cl.[3] ..... B63B 3/06

[52] U.S. Cl. ..... 114/357; 114/358; 114/65 R

[58] Field of Search ..... 428/44, 47, 105, 106; 144/315 A, 309 AB, 82, 84, 78, 56, 345, 355–359; 156/242, 196, 189; 264/32, 501, 510, 511, 512, 531, 554, 571, 313, 315, 326

[56] References Cited

U.S. PATENT DOCUMENTS

| | | | |
|---|---|---|---|
| Re. 29,072 | 12/1976 | Zondek | 156/196 |
| 1,168,828 | 1/1916 | Schmitt | 144/309 AB |
| 1,214,863 | 2/1917 | Woeste | 428/11 |
| 1,470,008 | 10/1923 | Hawkins | 264/313 X |
| 1,819,775 | 8/1931 | Elmendorf | 428/155 |
| 2,368,821 | 10/1945 | Tardiff | 9/6.5 |
| 2,400,771 | 5/1946 | Moxhan, Jr. | 114/82 |
| 2,411,497 | 11/1946 | Bamer | 9/6.5 |
| 2,941,216 | 6/1960 | Carlson | 156/196 |
| 2,980,153 | 4/1961 | Burch | 144/309 AB |
| 3,002,202 | 10/1961 | Luger, Jr. et al. | 9/6 W |
| 3,591,443 | 7/1971 | Cox | 428/47 |
| 3,687,768 | 8/1972 | Vailzes et al. | 156/212 |
| 3,793,768 | 2/1974 | Surving | 156/242 |
| 4,032,684 | 6/1977 | Johnson et al. | 428/155 |

FOREIGN PATENT DOCUMENTS

| | | |
|---|---|---|
| 248905 | 12/1965 | Austria . |
| 63737 | 2/1949 | Netherlands . |
| 100101 | 10/1940 | Sweden . |
| 881448 | 11/1961 | United Kingdom . |
| 1062152 | 3/1967 | United Kingdom . |

*Primary Examiner*—Sherman D. Basinger
*Attorney, Agent, or Firm*—Stanley C. Spooner

[57] ABSTRACT

Disclosed is a building panel curved along the major and minor axes which can be manufactured from a plurality of strips of building material each having the same geometric shape. A mold is provided upon which a first layer of geometrically identical strips is temporarily fastened. In a preferred embodiment, at least a second layer of strips is provided over the first layer and bonded thereto by an epoxy adhesive. Because all of the strips have the same geometric shape and can be mass produced and a compound or complex curvature panel can be made at extremely low cost. Additionally, disclosed is the application of such a compound or complex curved panel to the housing and in the preferred embodiment, boat building fields. Additionally disclosed is the method of applying such a panel to the building of a boat hull.

8 Claims, 14 Drawing Figures

Fig. 1
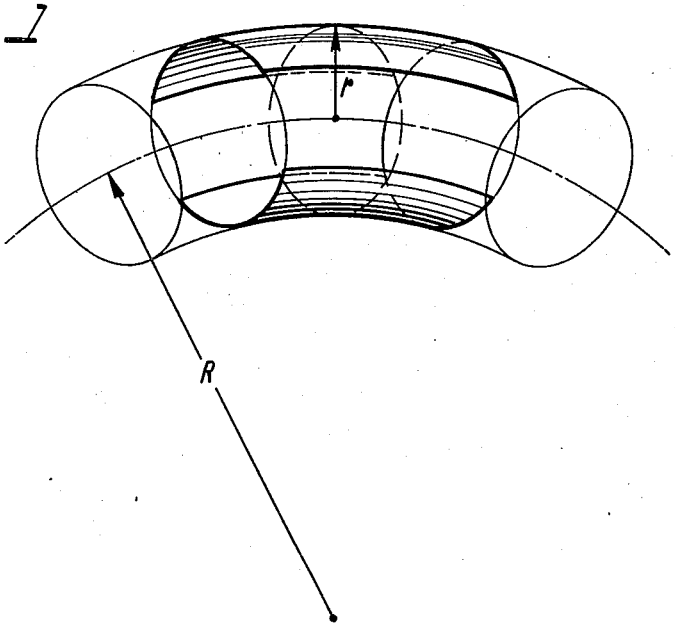
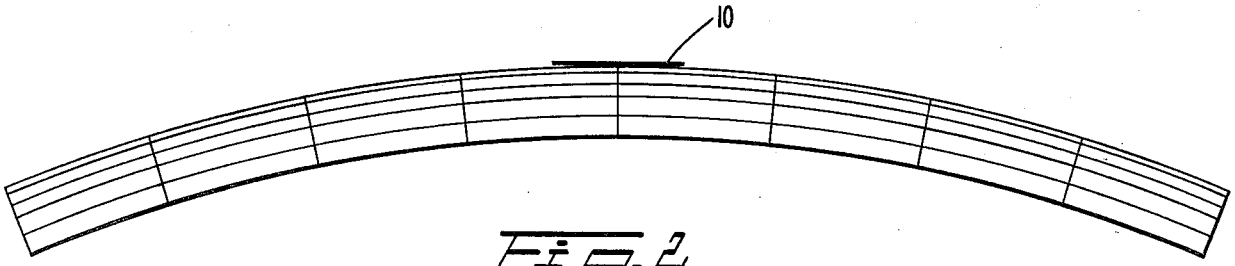
Fig. 2
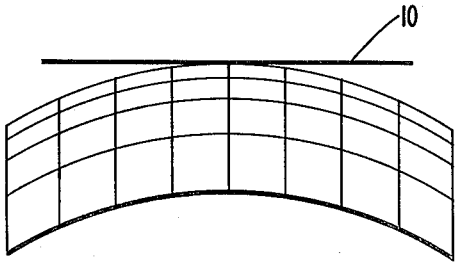
Fig. 3

Fig. 4
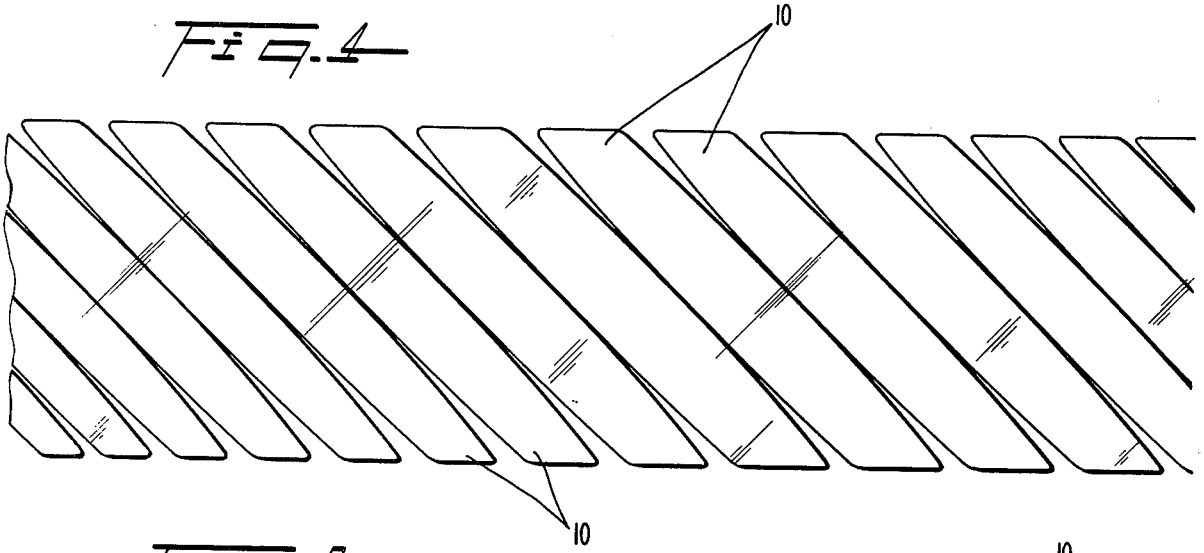
Fig. 5
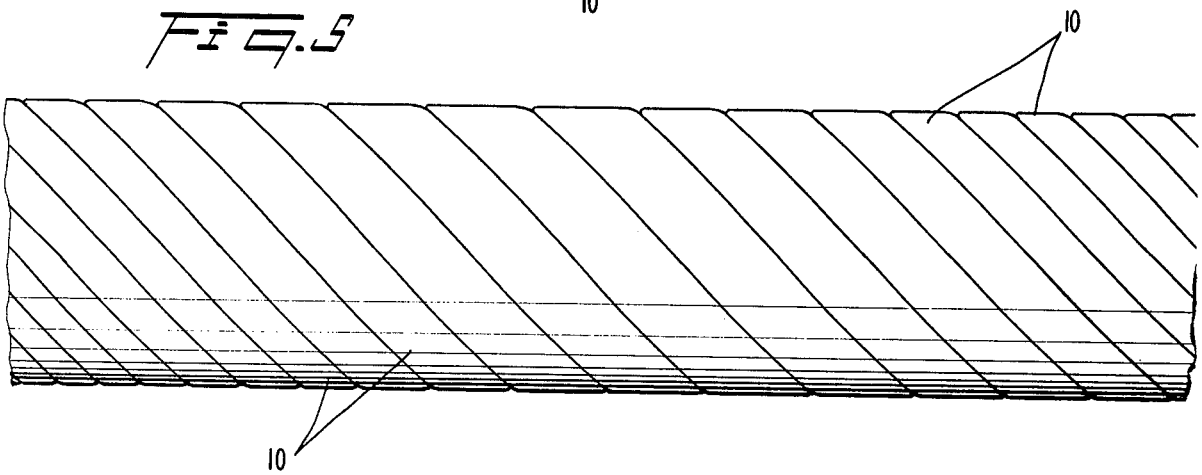
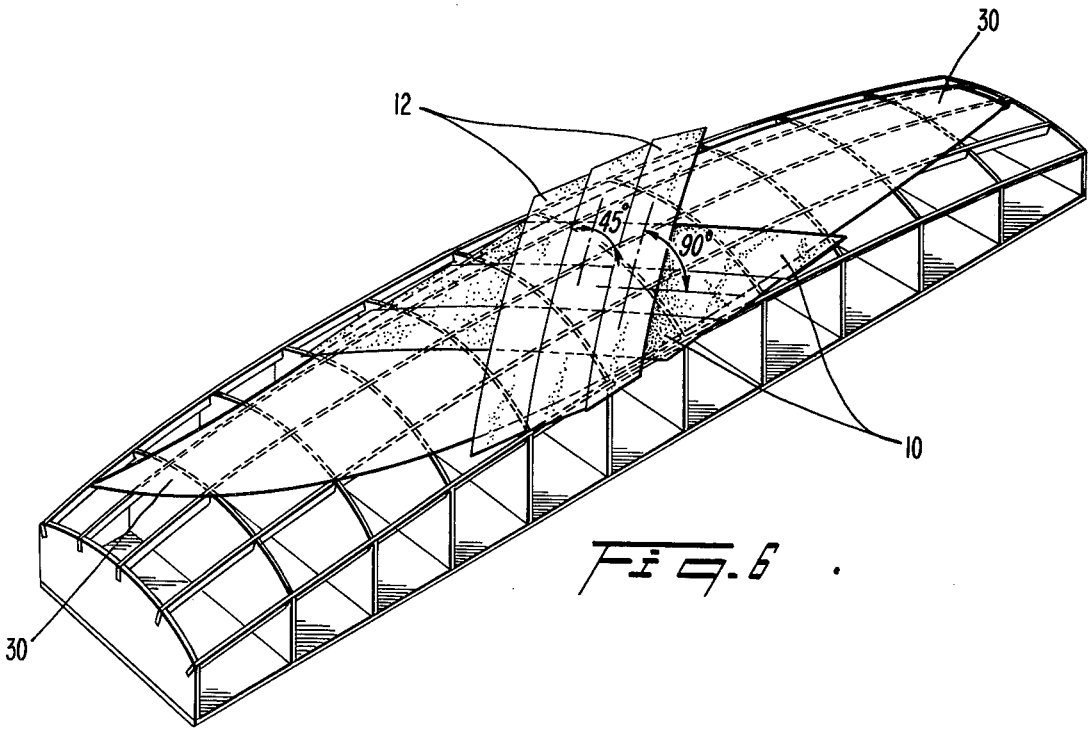
Fig. 6

Fig. 9
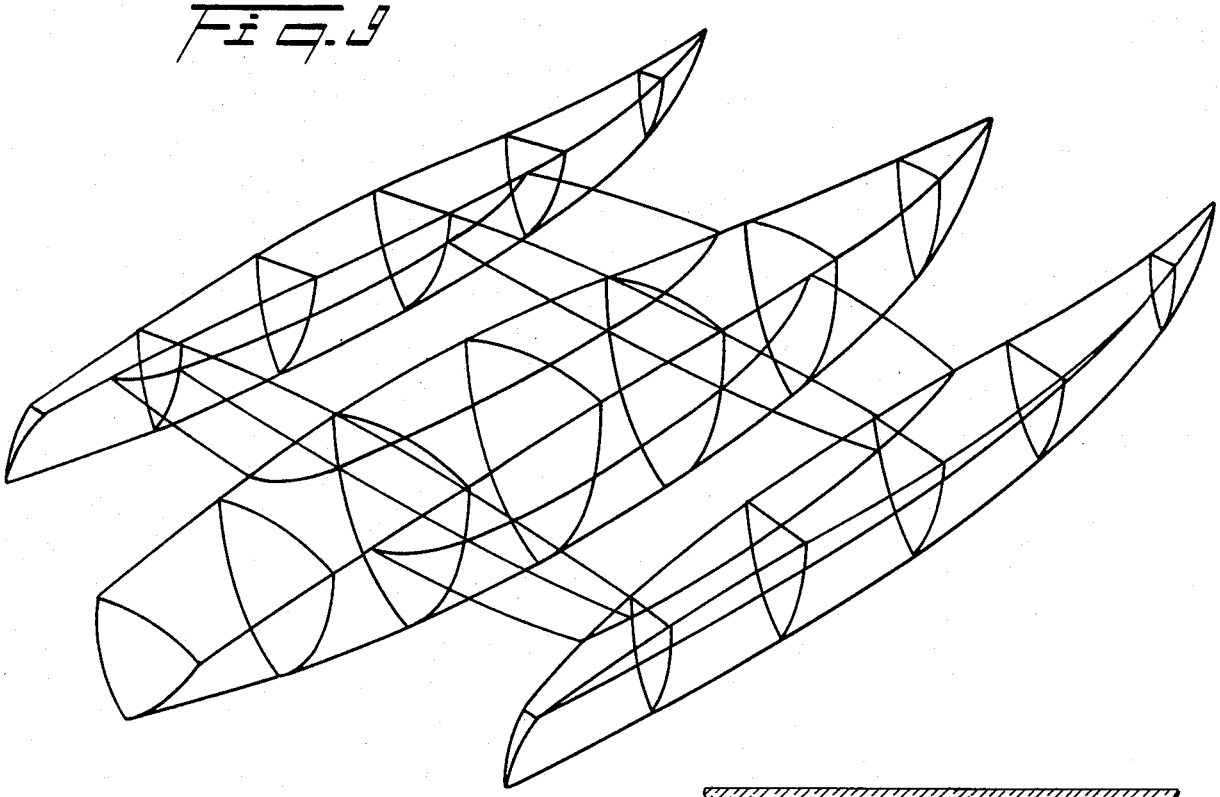
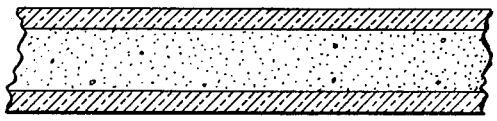
Fig. 11d
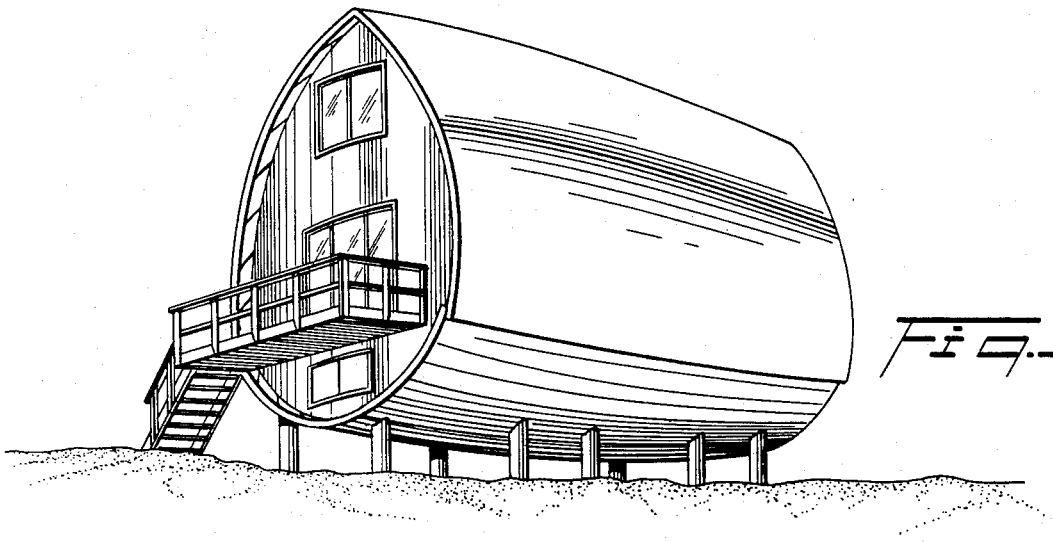
Fig. 10

METHOD OF MANUFACTURING AND APPLICATIONS OF A BUILDING PANEL HAVING A COMPOUND OR COMPLEX CURVATURE

BACKGROUND OF THE INVENTION

Disclosed is a building panel curved along both major and minor axes and relates to the building industry in general and the boat building field in particular.

As is known in the boat building, aircraft and other industries, it is extremely difficult to provide panels with curvatures in both the major and minor axes (compound and complex being the most common of such curved surfaces). It has long been known that a compound curved wooden surface can be made by the process of "cold-molding" which consists in fitting together a plurality of small strips of flat building material in order to produce a larger surface which is curved in one or more directions.

In order to achieve maximum strength, it is desirable to have as close a fit as possible between adjacent edges of the fitted strips. In the past the close fit between strips is achieved by hand carving the edges of each strip resulting in a unique geometric shape for each strip depending on the curve of the surface desired. In the boat building field this custom-fitting process is known as "spiling" and the labor involved is very expensive. Consequently, because of the time, skill and cost of this operation, mass production of panels having compound or complex curvatures is extremely challenging and necessarily expensive. Further complicating prior art "cold-molding" techniques is the problem of bi-lateral structures: for example the starboard half and port half of a two-piece boat hull. Because these hull sections are the mirror image of each other, separate molds jigs, frames etc. are necessary in constructing the two hull sections. The fact that parts used in producing the port section cannot be used to form the starboard section, doubles the material necessary and consequently raises the cost of hull construction.

A more complete appreciation of the difficulties in providing a surface curved in two directions with respect to water vessels may be had by reference to U.S. Pat. No. 2,235,601 which acknowledges that each plank must be "planed to final shape" in order to fit with the other planks forming the hull section.

Thus it will be readily understood that there is a long felt need for a practical method for producing building panels curved in two directions from a basically flat planar material. There is a need to overcome the necessity for individual hand carving of multiple planks in order to fit the two-dimensional material into the desired multiply curved final shape. It is clear that should a method be provided for the inexpensive manufacture of such curved panels, there are numerous applications which, although previously were not economically viable, would become feasible.

SUMMARY OF THE INVENTION

In view of the above, it is an object of the present invention to provide a method for the construction of a building panel curved along its major and minor axes which is economically feasible on a mass production basis.

It is a further object of the present invention to provide a building panel having the weight and strength characteristics of a surface curved in two directions while at the same time capable of being inexpensively manufactured.

A still further object of the present invention is to provide a method of constructing the hull of a boat utilizing panels curved along major and minor axes said hull being light weight, strong and inexpensive.

It is a further object of this invention to provide a mass producible panel curved along major and minor axes from planar strips which are easily mass produced.

The above and other objects are achieved by providing a mold which has a surface curved in both major and minor axes, said surface being one of a family of surfaces which can be made from a layer of geometrically identical strips. With such a mold, the geometrically identical strips can be mass produced out of any suitable building material and bonded together in a layer or layers as desired. Although the specific shape of each of the strips is dependent upon the curvature and/or changes in curvature in the surface of the building panel to be built, each strip can be geometrically identical to its adjacent strip faciltating the manufacture of the panel. Additionally, the economy ans strength of building such panel provides a simple and inexpensive method of building boat hulls by combining hull sections made from such building panels and joining the hull sections along a keel seam without the need for the extensive internal bracing and structures necessary in a conventionally built hull.

BRIEF DESCRIPTION OF THE DRAWINGS

A more complete appreciation of the invention and many of the atendent advantages thereof will be readily apparent by reference to the accompanying drawings wherein:

FIG. 1 is a geometrical representation of compound and complex surfaces;

FIG. 2 is a side view of a mold in accordance with one embodiment of the applicant's invention;

FIG. 3 is an end view of the mold in FIG. 2;

FIG. 4 is a top view of veneer strips placed on the top of the mold;

FIG. 5 is a top view of veneer strips which have been forced to conform to the top surface of the mold;

FIG. 6 is a perspective view showing the mold, portions of two layers of strips and the outline of a hull section on the finished panel;

FIGS. 8 and 9 are perspective drawings showing the utilization of building panels in catamaran and trimaran hulls, respectively;

FIG. 10 is a perspective view showing the utilization of building panels in the building of a house; and FIGS. 11*a*, 11*b*, 11*c* and 11*d* are cross sectional views showing the variations in layers of preferred embodiments of the invention.

DESCRIPTION OF THE PREFERRED EMBODIMENT

Figure 7:
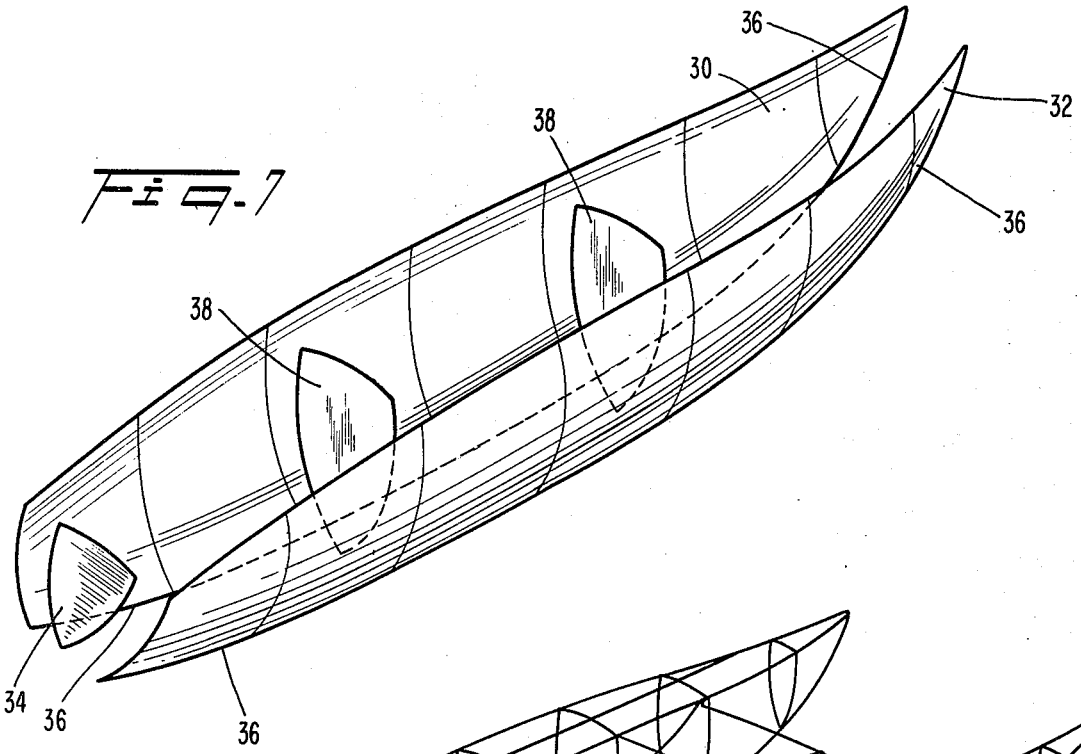
FIG. 7 is a perspective view showing the assembly of two hull sections with a transom and two bulkheads.

Referring now more particularly to the drawings wherein like numerals designate identical parts throughout the several views, and more particularly to FIG. 1, there is shown a portion of a torus having a major radius of curvature R and a minor radius of curvature r. It can be seen that a section of the outer surface of the torus has a compound curvature in that the centers of curvature are located on the same side of the surface. The inner section of the surface of the torus is a complex surface in which the centers of curvature are on opposite sides of the surface. The line scribed by the radius R is considered to be the longitudinal or major axis of the surface with the line scribed by radius r is a transverse or minor axis of the surface. Although the compound curvature in the outer surface of the torus is presently seen as a preferred embodiment, there are numerous other surfaces contained in the family of surfaces which can be described as capable of being constituted by a plurality of geometrically identical strips of building material.

It should be noted that the strips of building material utilized do not have to by symmetrical, of uniform thickness or of any particular material but only must have the characteristic of being geometrically identical to other strips utilized in the basic building panel. It is also noted that as shown in FIG. 1, the indicated radii of curvature r and R do not have to be constant and could vary as long as the condition of identical geometric strips is met.

However, in a preferred embodiment, a constant camber (radius of curvature) mold is provided which allows the formation of the building panel having a constant radius of curvature in both the major and minor axes. FIG. 2 also shows the location of a single building strip 10 in its planar condition on the mold. FIG. 3 is an end view showing the orientation of the single strip in reference to the surface of the mold.

FIG. 4 shows the orientation of a plurality of strips which would form one layer in the finished building panel, however, the strips are depicted in FIG. 4 as being primarily in the same plane. In FIG. 5, however, the strips have been bent down to conform to the surface of the mold and it is noted that there is substantial edge contact between adjacent strips in their "conformed" or bent down position.

Substantial edge contact in the context of this specification is understood by those of ordinary skill in the art to be comprised as follows: there is substantial edge contact between strips when the gap between the strips is less than the gap which would be between adjacent strips which did not possess at least one curved edge. It can be seen that, if the strips did not have at least one curved edge, when they were "conformed" to the mold, large gaps would occur between the portions of the strips, thus, the more costly and heavier the panel.

One embodiment of the present invention serves to eliminate this problem by having at least one curved edge per strip which provides substantial edge contact among adjacent strips.

In a preferred embodiment, the various strips would be temporarily retained in this "conformed" arrangement and a second layer of strips placed over the first layer and bonded thereto. Practically, the first layer of strips may have their edges bonded together but a much stronger bond is formed when the second layer of strips is placed over the first layer. FIG. 6 illustrates the placing of a second layer of strips 12 over the first layer with a preferred orientation being a 90 degree angle between the major axes of the strips in adjacent layers. In addition, this preferred orientation has a 45 degree angle with respect to the longitudinal axis of the mold itself. Clearly depending upon the desired torsional characteristics of the building panel being created, different orientation angles may be desirable. Additionally, more than the two layers shown can be utilized to provide a building panel having the desired strength characteristics.

In one embodiment, a total of three layers of one eighth-inch thick wood veneer were utilized, with the strips of each layer oriented with angles as shown in FIG. 6. The adhesive used is WEST$^{TM}$ system epoxy resin No. 105-205 available from Gougeon Brothers, Inc., 706 Martin St. Bay City, Mich. 48706. The adhesive was liberally applied to each pre-cut mass produced strip of wood veneer with the veneer then being placed on the mold. The mold can be treated with a mold release agent to prevent the panel from sticking to the mold as it is being built up or suitable plastic insultation or other material can be used for this purpose.

In order to "conform" each strip to the curved surface of the mold, nails or staples can be used to temporarily hold the first layer in place with a second or subsequent layers stapled or nailed together to achieve the necessary pressure between layers. Other means of achieving the pressure between layers (in order to achieve a good wood/epoxy bond) could be vacuum bag molding, matched platen molding, removable nailing, etc. Clearly when the epoxy has "set up" and/or been cured, the temporary restraining devices used on the first layer can be overcome and the panel removed from the mold. The finished building panel is light in weight but extremely strong due to the "egg shell" like structure (a structure curved in two directions) and thus could have many uses and applications. In a preferred embodiment, panels made as indicated were utilized as the basis for the hull of the sail boat which has already undergone extensive sea trials.

As shown in FIG. 6, the desired shape of a hull section can be cut out of a curved building panel with these hull sections assembled as indicated in FIG. 7. The starboard hull section 32 would be the mirror image of port hull section 30 and in the preferred embodiment may be taken from the same mold (due to the constant radius of curvature in both the major and minor axes of the mold). For added strength, a transom 34 could also be formed from an excess portion of the building panel. These three pieces would be fitted together, the hull sections meeting along the keel line 36 and bonded together. To facilitate this process, it may be expedient to utilize one or more internal bulkheads 38 to retain the hull sections in the appropriate position until the keel lines of the respective sections can be bonded together. Transom 34 would then be bonded into place forming a water-tight hull that is light, inexpensive and extremely strong.

Figure 8:
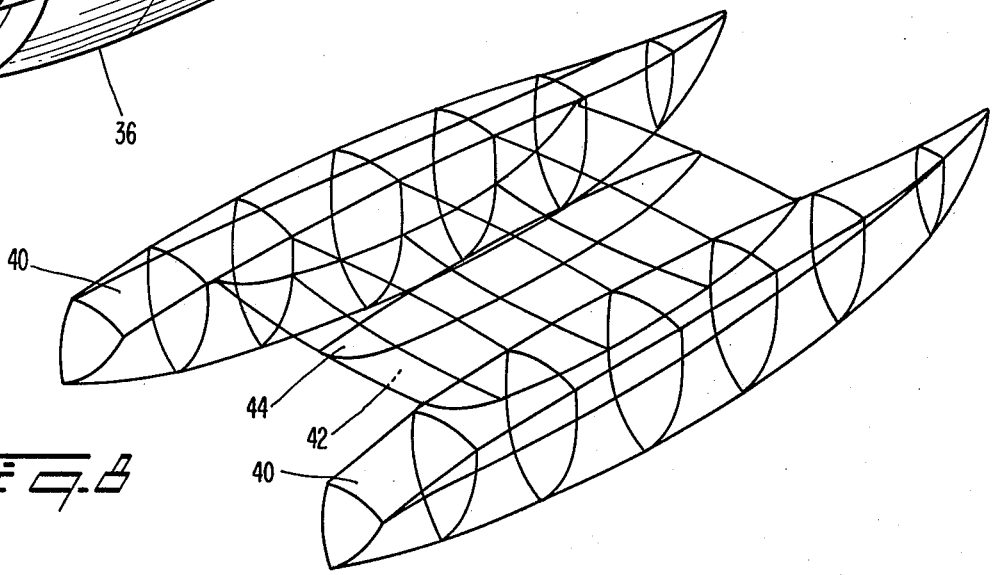

As shown in FIG. 8, the basic catamaran configuration could make extensive use of such building panels not only utilizing them for the hull sections and transoms as shown in FIG. 7 but also for the decking 40 and the hull interconnecting structures 42 and 44. Similarly, a trimaran utilizing the same basic building panel construction could be built relatively inexpensively compared to the cost of conventionally built catamaran and triamaran type hulls. It should be noted that all of the surfaces shown could be made from building panels obtained from the same mold. Thus it would be unnecessary to provide a plurality of molds having different radii of curvature etc. to provide the differing size structures utilized in the two hulls.

Additionally, the building panels, in addition to being assembled in a variety of shapes and configurations, can tolerate a degree of contorsion (torsiou, bonding compression or tension) along their surface. In the utilization of the building panels for a sail boat hull, it may be desirable to squeeze the panels closer together in the forward part of the hull to provide a "finer" entry form into seas into which the hull will be utilized. Although the same effect could be achieved by having a mold which is contorted, it may be more desirable (because the mirror-image hull sections can be obtained from the same mold) to contort the hull sections after they have been formed.

In the preferred embodiment, joining of the panels is easily accomplished using modern adhesives such as the epoxy mentioned above reinforced with cotton or glass fibers. After the panels have been joined, a monocoque effect is achieved which will deter further contortion of the panels. In fact, such structures as shown in FIGS. 8 and 9 exhibit great dimensional stability without the necessity of complex internal skeletons generally required of such craft. The combination of the compound curvature or "eggshell rigidity" with the "monocoque" effect is to provide an extremely strong and lightweight hull. In one embodiment, a thirty-foot trimaran sail boat was constructed and sailed one-thousand miles in the ocean entirely without any internal skeleton.

Using different molds, curved panels can be mass produced from flat building materials to provide an architect with a variety of panel shapes which can be combined into an infinite number of structures while utilizing relatively standard, pre-formed, mass-produced building panels, especially when the panels can be contorted as earlier noted.

FIG. 10 shows a modification of a house design adapted from U.S. Dept. of Agriculture plans which could utilize panels produced in accordance with the inventive method. Again, the "eggshell rigidity" combined with the low cost and self-supporting nature of the structure provides a viable alternative for home design. With such a building, the architect has complete freedom to arrange interior spaces as desired because the dwelling needs no internal skeleton. The transportation of the building panels because of their light weight is simplified. In fact one of the major drawbacks of the home building industry is that conventional housing must be framed first with the skeleton totally unprotected. The panels comprising the bottom and side portions of the structure can be transported and assembled immediately into a closed-in area providing a protected area for the completion of the building.

At least two separate panels or portions thereof when joined will provide a closed in space. FIG. 10 shows 5 panels; 2 roof, 1 floor and 2 end, which form a more conventional dwelling.

Additionally, the mass production of such panels will reduce the cost per panel to a level well below the present housing costs.

Figure 11A:
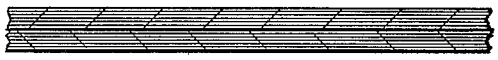
Figure 11B:
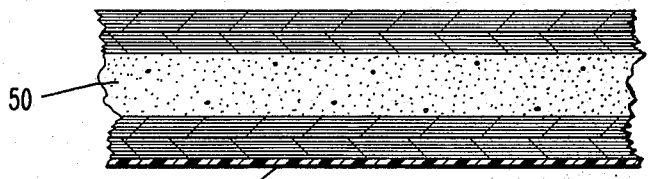
Figure 11C:
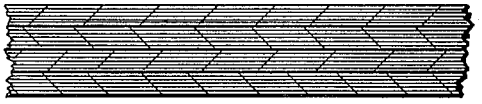

FIGS. 11*a*–11*d* are cross sectional views of preferred embodiments of the building panels although depending upon the application, numerous other types of panels will be readily apparent in view of the teachings to those of ordinary skill in the art. FIG. 11*a* shows a conventional two-layer panel utilizing wood veneer strips as structural elements. In the event thermal insulation is desirable (as in the embodiment of FIG. 10) or greater panel thickness for increased rigidity, a layer of core material such as plastic foam may be added in the form of planar strips or sheets each having identical geometric shape, and this is sandwiched between two or more layers of structural elements such as wood veneer strips and/or molded fiberglas. A weather-proof exterior 52 can be added to protect the building panel from the elements. If strength of the building panel is critical, multiple layers of structural elements can easily be built up as indicated in FIG. 11*c*. A molded fiberglas reinforced plastic (FRP) could be laid up on the mold with core material to follow. The core could have the identical shapes and be bonded to the FRP. A second layer of FRP could follow providing a FRP-Core-FRP "sandwich" as in FIG. 11*d*. Numerous core materials such as foam, balsa, etc. are known and would have the effect of further increasing the strength of the panel.

In view of the above disclosure, a number of variations and modifications to the basic invention will be readily apparent to those skilled in the art in view of the above teachings. The building material can be structural elements or core material or a combination thereof depending upon the desired application. For example, and as previously noted, numerous molds having varient curvatures can be provided which are capable of being covered by strips having an identical geometrical shape depending on the desired building panel application. The radii of curvature of the mold can be constant or vary as necessary. The basic building materials could be wood, plastics, foam, pre-produced fiberglas strips, etc. The only requirement of the building material is that it be compatible with a strong adhesive of some sort and that it be capable of being conformed to a mold during the layering process. Obviously the adhesive utilized and the method of conforming strips to the mold vary dependent upon the building materials and the application. Just as clearly, only that area of a mold necessary to produce the desired size panel will be covered by the alternating layers of strips, thus providing economy of operation if smaller than standard size panels are desired. As long as a panel has a single layer, made up of strips noted earlier, it falls within the scope of the present patent.

The detailed description of the specific embodiments set forth above is by way of illustration only and is not to be taken as limiting the applicant's invention, which is limited only by the scope of the claims appended hereto.

What is claimed as new and desired to be secured by Letters Patent of the United States is:

1. A method of building a boat hull comprising the steps of:

forming at least one hull panel on a mold having a two-dimensional surface curved along both major and minor axes, said surface being one of the family of surfaces capable of being covered by a plurality of identical geometrically shaped planar strips with substantial edge contact, said forming step including the steps of conforming to said curved surface a first plurality of substantially planar strips of building material making up at least a first layer, and joining each of said strips at least to an adjacent strip by a means for interconnecting while said strips are conformed to said mold surface;

forming from said at least one hull panel two hull sections; and bonding said two hull sections together to form a water-tight boat hull.

2. A method according to claim 1, said bonding step including bonding a transom to said two hull sections to form a water-tight boat hull.

3. A method according to claim 2, said bonding step further includes bonding a deck section to said boat hull to provide eggshell rigidity to said boat hull.

4. A method according to claim 1, said method including after said joining step, the additional steps of:

conforming a second plurality of substantially planar strips of building material in at least a second layer to said at least first layer; and joining said at least a second layer to said at least a first layer.

5. A method according to claim 4, wherein said strips have a longitudinal axis and said second conforming step includes the step of conforming said second plurality of strips such that the longitudinal axes of said strips in said second layer form an angle with the axes of said strips in said first layer.

6. A method according to one of claims 1–5, said method includes prior to said bonding step, the step of contorting at least one of said hull sections to a configuration such that the resultant curved surface has a different curvature than said mold along said major and minor axes.

7. A method according to claim 5, including, prior to said bonding step, the additional steps of:

providing at least one bulkhead;

at least temporarily contorting at least one hull section around said bulkhead; and during said bonding step, the additional step of maintaining said section in said contorted condition during said bonding step.

8. A method of building a boat hull comprising the steps of:

preforming at least one hull panel on a mold having a two-dimensional surface curved along both major and minor axes, said surface being one of the family of surfaces capable of being covered by a plurality of identical geometrically shaped planar strips having two curved edges and substantial edge contact, said preforming step including the steps of:

conforming to said curved surface a first plurality of substantially planar strips of building material making up at least a first layer;

joining each of said strips at least to an adjacent strip by means of an adhesive;

conforming a second plurality of subatantially planar strips of building material to said first layer forming at least a second layer; and joining each of said second plurality of strips at least to said first layer of strips;

forming from said at least one hull panel, port and starboard hull sections, one of said sections being the mirror image of the other of said sections;

providing at least one bulkhead;

elastically deforming said hull sections around said bulkhead; and bonding said hull sections to each other and to a transom such that the curvature of each hull section is now different from said mold.

* * * * *